US008452205B2

(12) United States Patent
Kawamoto

(10) Patent No.: US 8,452,205 B2
(45) Date of Patent: May 28, 2013

(54) IMAGE FORMING APPARATUS HAVING SKELETAL STRUCTURAL SHAFT

(75) Inventor: Motoji Kawamoto, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 346 days.

(21) Appl. No.: 12/888,253

(22) Filed: Sep. 22, 2010

(65) Prior Publication Data

US 2011/0081162 A1 Apr. 7, 2011

(30) Foreign Application Priority Data

Oct. 6, 2009 (JP) ..... 2009-232436

(51) Int. Cl.
*G03G 15/00* (2006.01)

(52) U.S. Cl.
USPC ..... 399/107; 399/110

(58) Field of Classification Search
USPC ..... 39/107, 110; 399/107, 110
See application file for complete search history.

(56) References Cited

U.S. PATENT DOCUMENTS

2005/0069340 A1* 3/2005 Noda et al. ..... 399/107
2008/0003015 A1* 1/2008 Tomatsu ..... 399/110

FOREIGN PATENT DOCUMENTS

JP 2001-066840 3/2001

* cited by examiner

*Primary Examiner* — Sophia S Chen
(74) *Attorney, Agent, or Firm* — Squire Sanders (US) LLP

(57) ABSTRACT

An image forming apparatus for forming an image on a sheet, includes: a pair of panels which constitute a main body skeletal structure of the image forming apparatus and face each other; a main body skeletal structure shaft which connects between the pair of panels and is fixed to each of the pair of panels; and a unit which is installed between the pair of panels and needs positioning based on the main body skeletal structure shaft, wherein an exposed section which is provided on the main body skeletal structure shaft and serves as a measuring reference position for a measuring instrument when a positional relationship between the main body skeletal structure shaft and the unit is measured by use of the measuring instrument after completing assembling of the image forming apparatus.

12 Claims, 8 Drawing Sheets

IMAGE FORMING APPARATUS HAVING SKELETAL STRUCTURAL SHAFT

CROSS REFERENCE TO RELATED APPLICATION

The present application is based on Japanese Patent Application No. 2009-232436 filed with Japanese Patent Office on Oct. 6, 2009, and the entire content of which is hereby incorporated by reference.

BACKGROUND OF THE INVENTION

1. Field of Technology

The present invention relates to an image forming apparatus.

2. Description of Related Art

In image forming apparatuses such as a copying machine, a printer and a facsimile machine which employ an electrophotographic process, there are carried out image formations each being conducted through the process wherein an electrostatic latent image is formed on a photoconductor, and then, the electrostatic latent image is visualized with toner in a developer to be a toner image which is transferred onto a transfer member and is fixed.

The image forming apparatuses mentioned above are required to form images with higher image quality, and various methods to satisfy the requirement have been suggested. As one of these methods, for example, Japanese Patent No. 3728990 discloses a method to enhance stiffness of a skeletal portion of an image forming apparatus. Namely, it is one to enhance stiffness of the skeletal portion to eliminate a distortion of the whole of the image forming apparatus, and to arrange various units preserved in the skeletal portion so that their relative positional relations may be accurate.

Further, when a unit is replaced periodically, or when a unit needs to be replaced because of occurrence of troubles, there is sometimes an occasion where it is necessary to detect whether an installation position for the replaced new unit is the same as that in the initial state or not, in terms of positional accuracy.

When detecting the installation position of this kind, it is considered to utilize a fixed member that serves as a standard, and to measure a distance from the aforesaid member to the unit to be measured, as a detecting method. However, when assembly of an image forming apparatus in a prior art is completed, the member serving as a standard is covered by various types of units to be installed in the skeletal portion of the main body, in many cases, and large-scale disassembly is needed when utilizing the member representing the standard. Under certain circumstances, there is a possibility of occurrence of a problem that a unit is damaged in the middle of disassembly.

SUMMARY OF THE INVENTION

An object of the present invention is to provide an image forming apparatus wherein measurement of positional accuracy of a unit that requires positioning and accuracy verification are possible, even after completion of assembly of the image forming apparatus.

To achieve at least one of the above mentioned objects, an image forming apparatus for forming an image on a sheet, comprises: a pair of panels which face each other and constitute a main body skeletal structure of the image forming apparatus; a main body skeletal structure shaft which connects between the pair of panels and is fixed to each of the pair of panels; and a unit which is installed between the pair of panels and needs positioning based on the main body skeletal structure shaft, wherein an exposed section which serves as a measuring reference position for a measuring instrument when a positional relationship between the main body skeletal structure shaft and the unit that needs positioning is measured by use of the measuring instrument after completing assembling of the image forming apparatus is provided on the main body skeletal structure shaft.

It is preferred that the exposed section is an end portion of the main body skeletal structure shaft which passes through at least one panel of the pair of panels. It is further preferred that the end portion protrudes from the at least one panel of the pair of panels.

It is preferred that the image forming apparatus comprises a plurality of main body skeletal structure shafts. It is further preferred that the plurality of main body skeletal structure shafts are arranged in parallel.

DETAILED DESCRIPTION OF THE PREFERRED EMBODIMENTS

An embodiment of the invention will be explained as follows. Incidentally, the descriptions of the present section do not limit technical ranges of the claims and meanings of terminologies. Further, assertive explanations in the following embodiments of the present invention show the best modes, and do not limit meanings of terminologies and ranges of technologies.

Figure 1:
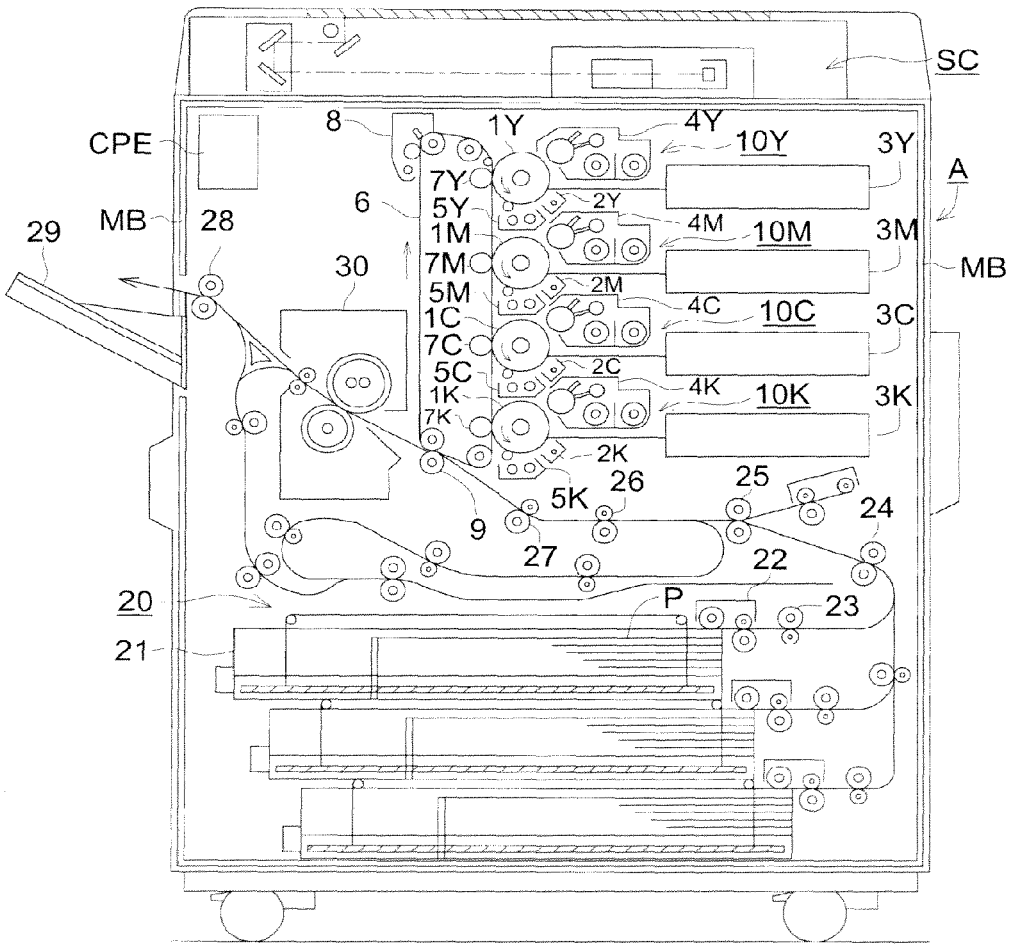
FIG. 1 is a schematic diagram showing an embodiment of the image forming apparatus relating to the invention.

FIG. 1 is a schematic diagram showing an embodiment of the image forming apparatus relating to the present invention, and main constituents of the image forming apparatus are image reading device SC and image forming section A.

The image reading device SC gives scanning exposure to a document placed on a document platen by using an optical system of a document image scanning exposure device, and results of the scanning exposure are projected on a line image sensor such as a CCD sensor. Images projected on the line image sensor are converted to analog signals which undergo analog processing, A/D conversion, shading correction and image compression processing in the image processing section, to be inputted in writing units 3Y, 3M, 3C and 3K.

Figure 2:
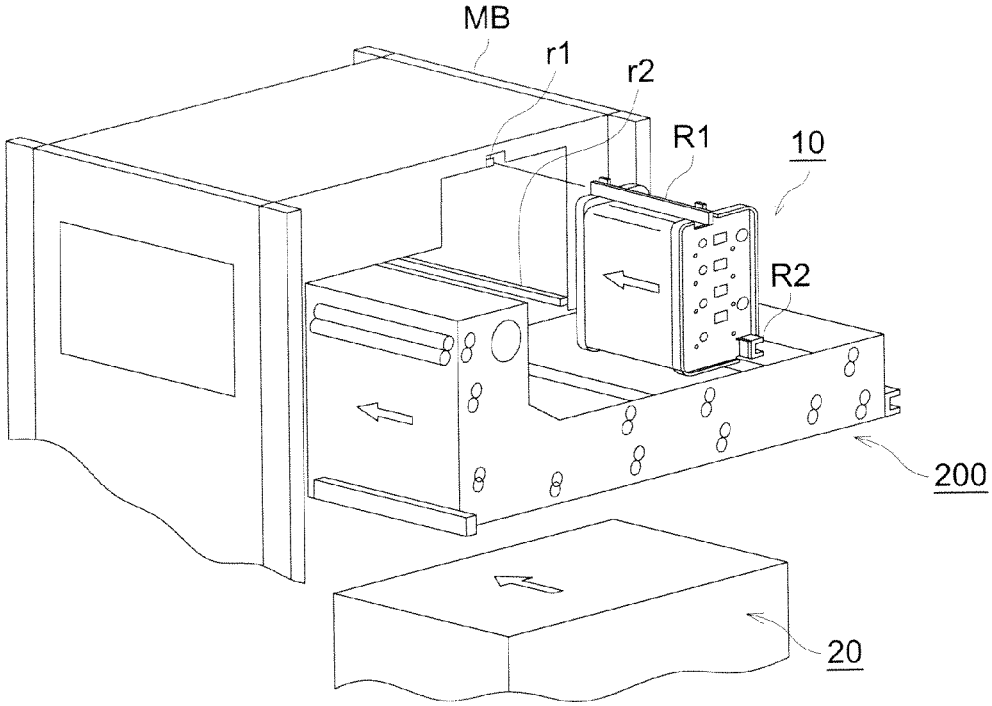
FIG. 2 is a perspective view showing how a unit is inserted in a skeletal portion of a main body.

The image forming section A is composed of writing unit 3, image forming unit 10, conveyance unit 200, sheet feeding device 20, electric section CPE including a control device, and of main body skeletal member MB. FIG. 2 is a perspective view showing how the image forming unit 10, the conveyance unit 200 and the sheet feeding device 20 are inserted in the skeletal portion of the main body.

In FIG. 1, the image forming section A is composed of plural sets of image forming units 10Y, 10M, 10C and 10K, belt-shaped intermediate transfer belt 6, the sheet feeding device 20 and of fixing device 30.

The image forming unit 10Y that forms an image in a yellow (Y) color has therein charging electrode unit 2Y that is arranged on the circumference of photoconductor drum 1Y representing an image carrier, writing unit 3Y, developing unit 4Y and cleaning device 5Y. The image forming unit 10M that forms an image in a magenta (M) color has therein photoconductor drum 1M representing an image carrier, charging electrode unit 2M, writing unit 3M, developing unit 4M and cleaning device 5M. The image forming unit 10C that forms an image in a cyan (C) color has therein photoconductor drum 1C representing an image carrier, charging electrode unit 2C, writing unit 3C, developing unit 4C and cleaning device 5C. The image forming unit 10K that forms an image in a black (C) color has therein photoconductor drum 1K representing an image carrier, charging electrode unit 2K, writing unit 3K, developing unit 4K and cleaning device 5K.

A latent image forming device is constructed by each of combinations including charging electrode unit 2Y and writing unit 3Y, charging electrode unit 2M and writing unit 3M, charging electrode unit 2C and writing unit 3C and charging electrode unit 2K and writing unit 3K.

Each of 4Y, 4M, 4C and 4K is developing unit 4 in which a two-component developer composed of small particle size toner for each of yellow (Y), magenta (M), cyan (C) and black (K) and of a carrier is filled up.

Intermediate transfer belt 6 is an inter mediate transfer body that preserves thereon temporarily a toner image developed by developing unit 4, and it is trained about plural rollers to be supported to be capable of rotating.

Images each being in a different color formed respectively by image forming units 10Y, 10M, 10C and 10K are transferred respectively by primary transfer devices 7Y, 7M, 7C and 7K onto rotating intermediate transfer belt 6 one after another, thus a composed color image is formed.

Recording medium (hereinafter referred to as a recording sheet) P loaded in sheet feeding cassette 21 of sheet feeding device 20 is fed by sheet feeding measure (first sheet feeding section) 22 to be conveyed to secondary transfer device 9 through sheet-feeding rollers 23, 24, 25, 26, and registration roller (second sheet feeding section) 27, and a color image is transferred onto recording sheet P.

Incidentally, the three-step sheet feeding cassette 21 arranged longitudinally in the vertical direction in the lower portion of image forming apparatus A has the structure that is mostly the same. Further, three-step sheet feeding measure 22 also has the structure that is mostly the same. The sheet feeding cassette 21 and the sheet feeding measure 22 are called sheet feeding device 20 collectively.

Recording sheet P onto which a color image has been transferred is interposed in the fixing device 30 wherein heat and pressure are given to the recording sheet P so that a color toner image (or, a toner image) on the recording sheet P is fixed to be established on the recording sheet P, and the recording sheet P is interposed by sheet ejection rollers 28 to be placed on sheet ejection tray 29 that is positioned outside an apparatus.

On the other hand, the intermediate transfer belt 6 from which the recording sheet P has been separated through a curvature after a color image is transferred onto the recording sheet P by secondary transfer device 9 is cleaned by belt cleaning device 8 so that residual toner may be removed.

Incidentally, though a color image formation was explained in the explanation of the image forming apparatus A, an occasion to form a monochrome image is also included in the present invention.

From now on, photoconductor drums 1Y, 1M, 1C and 1K are called image carrier (hereinafter, referred to as a photoconductor drum) 1, charging electrode units 2Y, 2M, 2C and 2K are called charging electrode unit 2, writing units 3Y, 3M, 3C and 3K are called writing unit 3 and developing units 4Y, 4M, 4C and 4K are called developing unit 4.

High tension at 5-10 kV supplied from DC power supply is impressed on a corona wire of charging electrode unit 2, and a surface of photoconductor drum 1 is charged by uniform and constant electric potential.

For the exposure system of the writing unit 3, a laser beam is used, and an amount of exposure is controlled by modulation of a pulse width.

(Main Body Skeletal Structure)

Next, a main body skeletal structure will be explained.

An object of the invention is to provide an image forming apparatus wherein measurement of positional accuracy and accuracy verification are possible even after completion of assembling of the image forming apparatus, for a unit that needs positioning.

In this case, the unit that needs positioning is a unit that is examined or replaced periodically and a unit that needs to be disassembled for replacing a carrier like a developing unit, and it is a unit that exerts important influences on image quality. Examples of them include a unit included in the image forming unit 10, and image forming unit stand 100 representing a casing for the image forming unit 10.

The main body skeletal structure of the image forming apparatus of the invention is connected to a pair of panels (front-rear panels) constituting the main body skeletal structure, for improving accuracy for assembling the main body skeletal structure, and main body skeletal structure shaft 32 fixed on each panel is provided on the main body skeletal structure. On the main body skeletal structure shaft 32, there is provided an exposed section that serves as a measuring position for a measuring instrument, so that a positional relationship between the main body skeletal structure shaft 32 and a unit that needs positioning may be measured by the use of the measuring instrument, after assembling of the image forming apparatus is completed.

Meanwhile, the main body skeletal structure shaft 32 may either be an axis that passes through the front-rear panels, or an axis that is in the so-called stepped form wherein both end portions are made to be smaller than an outer diameter of a shaft to be a diameter that can engage with a hole serving as a standard for the front-rear panels. In the present embodiment, an explanation will be given by using a shaft that passes through the front-rear panels.

When the main body skeletal structure shaft 32 that passes through the front-rear panels is used, an end portion of the main body skeletal structure shaft 32 that protrudes from the panel (the front panel in the present example) of at least one side of the front-rear panels is used as the exposed section.

In the case of the front-rear panels, when an empty space is provided in the vicinity of a position where the measuring instrument can operate, or when a position for measuring is covered by a plate, a small window or the like is provided on the plate so that exposure may become possible.

Though it is desirable that the number of the main body skeletal structure shaft 32 is one, in a viewpoint of engagement, a plurality of the main body skeletal structure shafts 32

(two main body skeletal structure shafts 32 in the present embodiment) are provided for the purpose of positioning in the rotational directions of the front-rear panels. In the following explanation, the main body skeletal structure representing the first standard shaft in the aforesaid two main body skeletal structure shafts 32 is made to be 32, and the main body skeletal structure representing the second standard shaft is made to be 32*a*.

Figure 3:
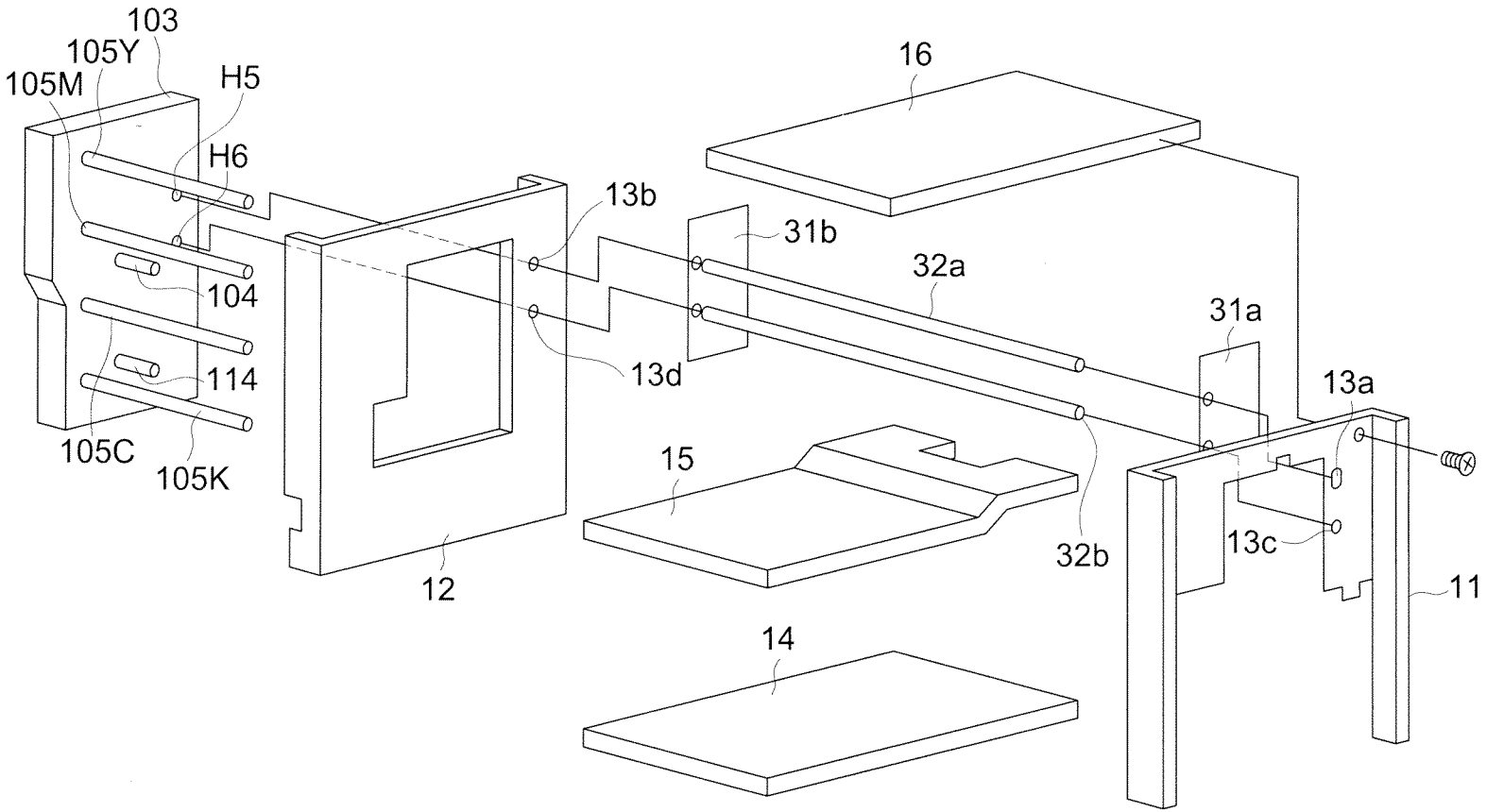
FIG. 3 is an exploded perspective view showing how to install a skeletal member of the main body.

FIG. 3 is an exploded perspective view for installing skeletal member of the main body. First, main body skeletal structure shaft 32*b* is caused to engage with standard holes 13*c* and 13*d* which are provided respectively on front panel 11 and rear panel 12 representing a pair of panels, and then, main body skeletal structure shaft 32*a* is caused to engage with hole 13*a* provided on front panel 11 and with hole 13*b* provided on rear panel 12. In this case, the hole 13*a* is made to be an elongated hole in the upward direction to absorb hole-boring errors. A mechanism (not shown) that adjusts to the hole 13*a* side is provided so that main body skeletal structure shaft 32*a* may be in parallel with main body skeletal structure shaft 32*b*. After the adjustment, front-rear panels 11 and 12 and main body skeletal structure shafts 32*a* and 32*b* are fixed by the use of unillustrated fixing members. After that, base plate 14, intermediate plate 15, top board 16 and drive panel 103 are attached.

Further, main body skeletal structure shafts 32*a* and 32*b* pass through front-rear panels 31*a* and 31*b* of casing 31 that constitutes writing unit 3. (In this case, front-rear panels 31*a* and 31*b* are caused to engage in advance, before the front-rear panels are caused to engage.).

(Drive Panel)

On the drive panel 103, there are installed drive measures such as a drum drive measure that rotates a drum and a developing drive measure that rotates a developing sleeve provided on developing unit 4.

As shown in FIG. 3, on the drive panel 103, there are embedded positioning pins 104 and 114 which conduct positioning for image forming unit stand 100 and drum shafts 105Y, 105M, 105C and 105K on which photoconductor drums are fixed. From now on, drum shafts 105Y, 105M, 105C and 105K are called drum shaft 105 collectively.

Figure 4:
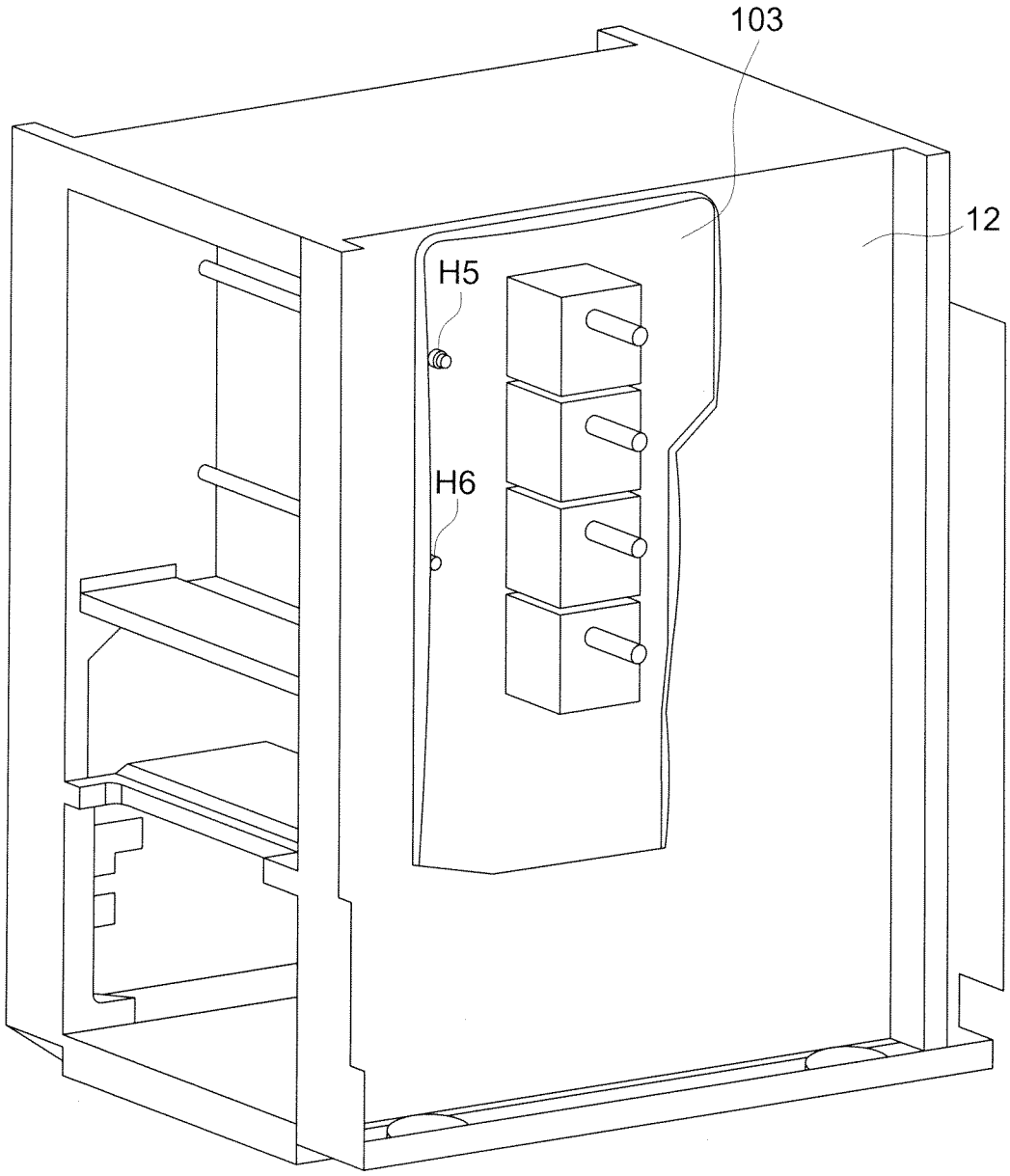
FIG. 4 is a perspective view that is viewed from the rear side and shows how a drive panel is installed on a rear panel.

FIG. 4 is a perspective view that is viewed from the rear side and shows how drive panel 103 is installed on a panel (rear panel 12 in the present embodiment). On the drive panel 103, there are provided hole 1-15 that engages with main body skeletal structure shaft 32*a* and hole H6 that engages with main body skeletal structure shaft 32*b*, and the drive panel 103 is aligned with the hole H5 and the hole H6 to be attached and fixed.

(Image Forming Unit 10)

Image forming unit 10 (excluding writing unit 3) is of the structure wherein photoconductor drums 1Y, 1M, 1C and 1K are attached longitudinally on image forming unit stand 100 representing a casing, and developing units 4Y, 4M, 4C and 4K and charging electrode units 2Y, 2M, 2C and 2K are installed on the circumference of each photoconductor drum.

Further, the image forming unit stand 100 houses therein intermediate transfer belt 6 and transfer units 7Y, 7M, 7C and 7K each transferring a toner image onto the intermediate transfer belt 6.

Figure 5:
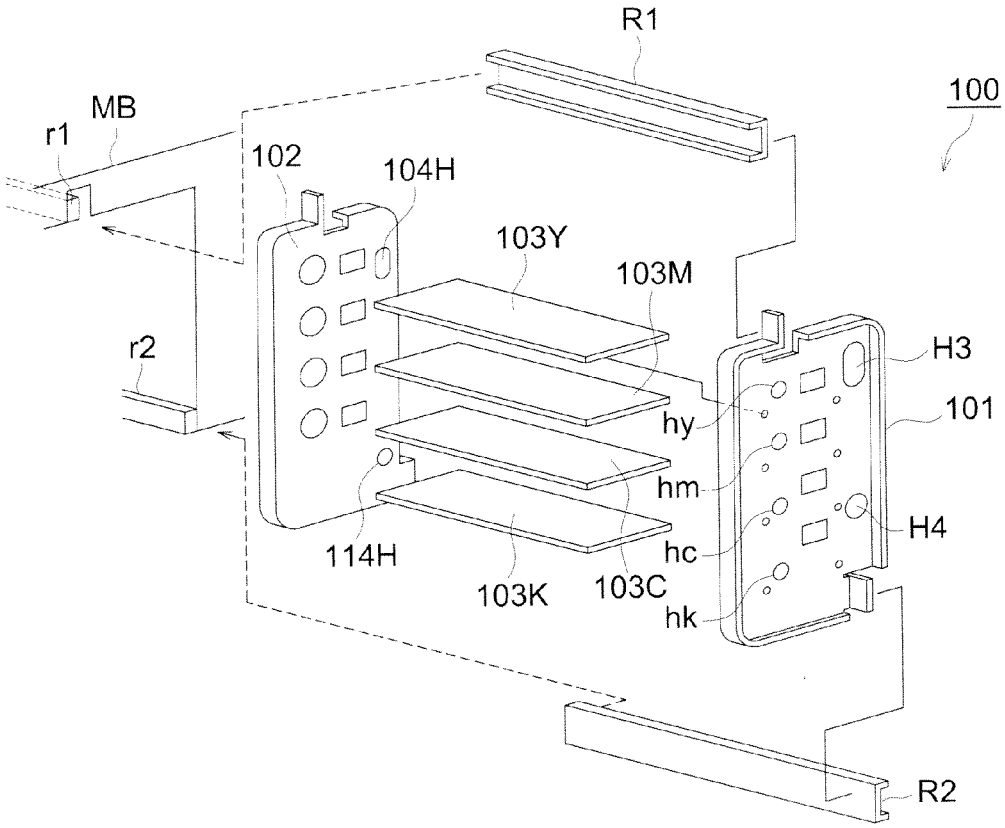
FIG. 5 is an exploded perspective view showing an example of a method for assembling a platform of image forming unit.
Figure 6:
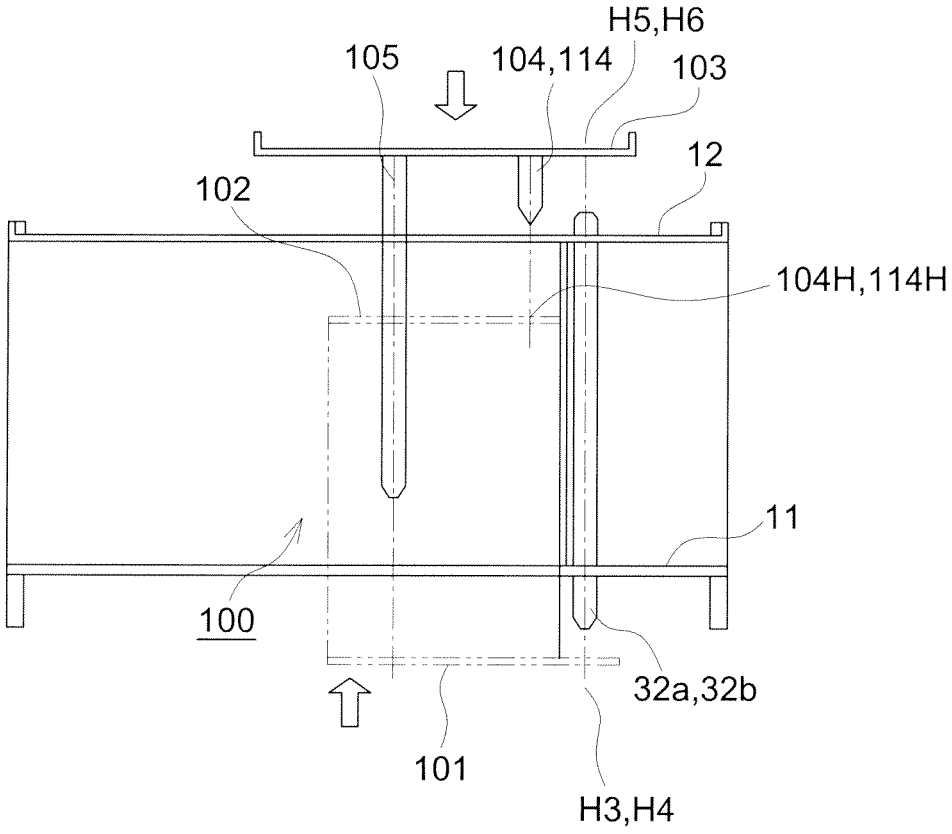
FIG. 6 is an exploded top view showing relationships among a main body skeletal shaft, a drive panel and a platform of image forming unit.

FIG. 5 is an exploded perspective view showing an example of a method for assembling image forming unit stand 100, and FIG. 6 is a top view showing a relationship among main body skeletal structure shafts 32*a* and 32*b*, drive panel 103 and image forming unit stand 100.

In FIG. 5, stays 103Y, 103M, 103YC and 103K on which developing units 4Y, 4M, 4C and 4K are installed respectively are attached on front plate 101 and rear plate 102 of the image forming unit stand 100, and further, rails R1 and R2 are attached on the front plate 101 and the rear plate 102. The rails R1 and R2 attached on the image forming unit stand 100 are in contract with rails r1 and r2 (not shown) which are attached on main body skeletal structure to be capable of sliding.

On front plate 101, there are provided holes H3 and 1-14 to be engaged respectively with main body skeletal structure shafts 32*a* and 32*b*, and when image forming unit stand 100 is inserted in the body skeletal structure, the holes H3 and H4 engage respectively with shafts 32*a* and 32*b*. Further, on rear plate 102, there are provided hole 104H and hole 114H which engage respectively with positioning pins 104 and 114 (see FIG. 3) which are embedded on drive panel 103. When the rear plate 102 engages with positioning pins 104 and 114, a positional relationship between image forming unit stand 100 and main body skeletal structure shaft 32 is determined. Incidentally, when the numeral 114 represents a reference positioning pin, hole 114H is made to be a circular hole, and hole 104H is made to be an elongated hole extending upward in the diagram. In the same way, the hole H4 is made to be a circular hole, and H3 is made to be an elongated hole extending upward in the diagram.

Further, on the front plate 101, there are provided holes hy, hm, hc and hk which engage respectively with drum shafts 105Y, 105M, 105C and 105K (see FIG. 3) which are embedded on the drive panel 103. Incidentally, with respect to processing for the holes hy, hm, hc and hk, they are formed based on hole H3 which serves as a standard. A positional relationship between drum shaft 105 and main body skeletal structure shaft 32*a* is determined by the engagement between the front plate 102 and the drum shaft 105.

(Writing Unit)

Figure 7:
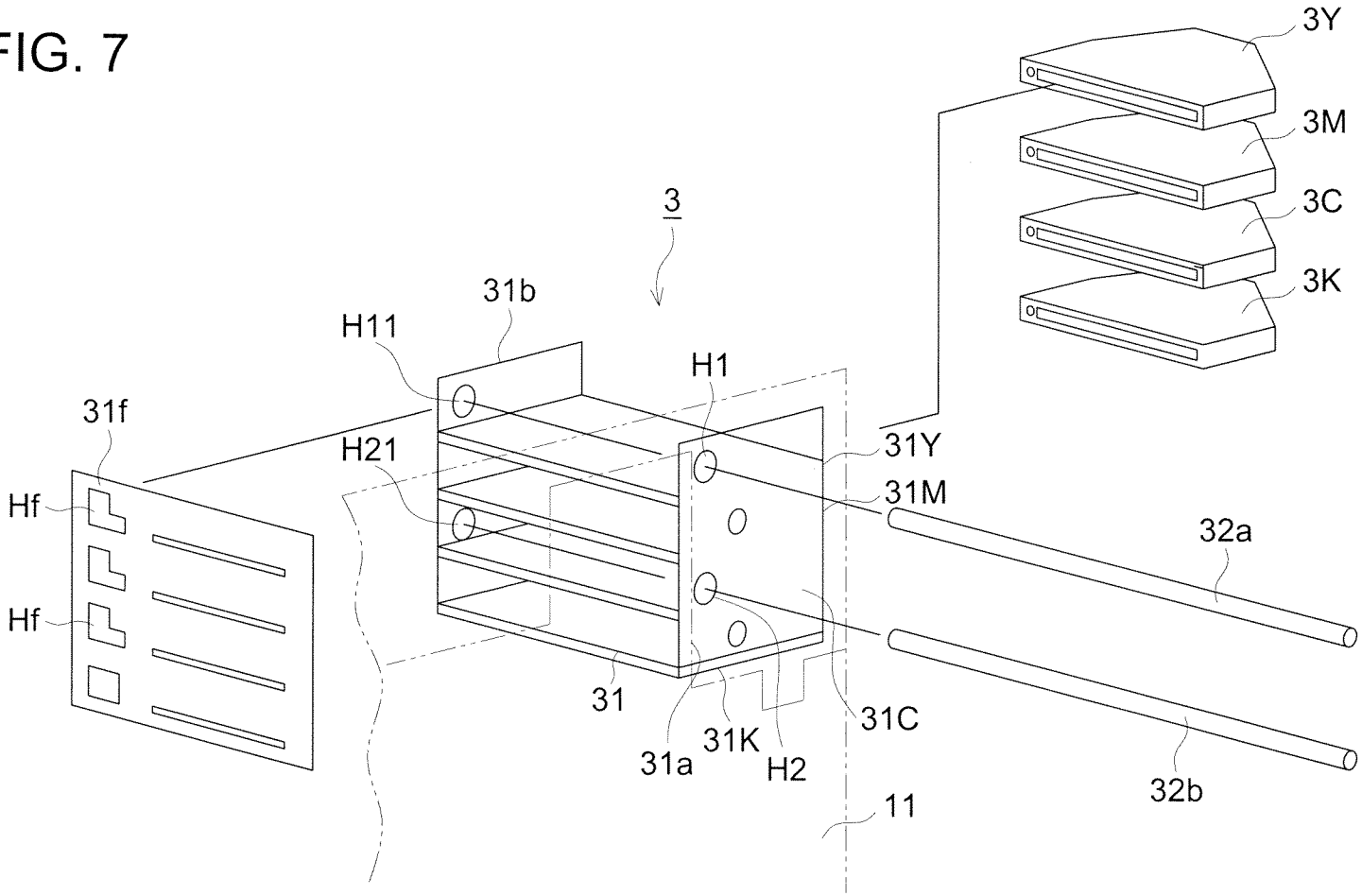
FIG. 7 is an exploded perspective view for writing units.

A relationship between writing unit 3 and main body skeletal structure shafts 32*a* and 32*b* will be explained as follows, FIG. 7 is an exploded perspective view of writing unit 3. Casing 31 of the writing unit 3 is composed of casing front panel 31*a* having two standard holes H1 and H2 through which main body skeletal structure shafts 32*a* and 32*b* pass, casing rear panel 31*b* having standard holes H11 and H21 and of casing front panel 31*f*. Further, there are provided bottom plates 31Y, 31M, 31C and 31K on which writing units 3Y, 3M, 3C and 3K are positioned respectively at prescribed positions, and there are provided unillustrated positioning pins.

The casing front panel 31*a* and casing rear panel 31*b* are assembled in advance when assembling the main body skeletal member (see FIG. 3).

On casing front panel 31*f*, there are provided holes in a minimum necessary amount so that toner particles scattered to a light emitting section of writing unit 3 may hardly adhere. Holes Hf provided on the casing front panel 31*f* are small windows used for measuring a distance from the main body skeletal structure shafts 32*a* and 32*b* to the unit that needs positioning with a measuring instrument, and they are arranged so that main body skeletal structure shafts 32*a* and 32*b* may be revealed.

Incidentally, the writing unit 3 may also be of the structure wherein the main body skeletal structure shafts 32*a* and 32*b* are not allowed to pass through, and casing 31 is incorporated into the main body skeletal structure from the back, and a device in which a position from the main body skeletal structure shafts 32*a* and 32*b* can be adjusted is provided.

(Verification of Accuracy Maintenance)

Measurement of positional accuracy and accuracy verification for the unit that needs positioning based on main body skeletal structure shaft 32 representing the standard after completion of assembling of the image forming apparatus will be explained as follows.

Figure 8:
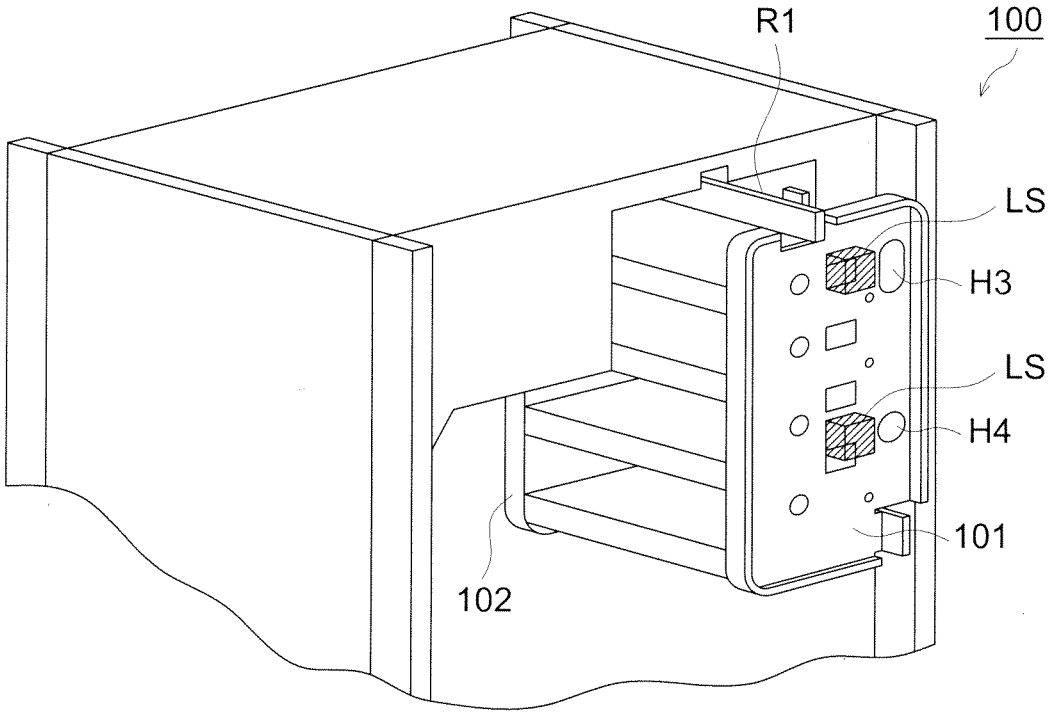
FIG. 8 is a perspective view showing an image forming unit on which a measuring instrument is installed.
Figure 9:
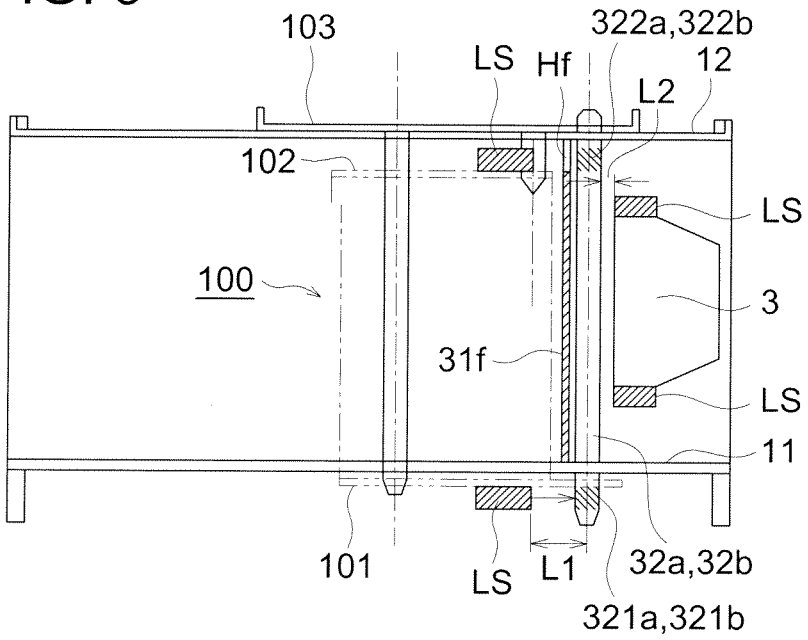
FIG. 9 is a top view showing how distance L up to a main body skeletal shaft is measured.

First, an explanation of a method to verify positional accuracy for image forming unit stand 100 and main body skeletal structure shafts 32*a* and 32*b* will be given. FIG. 8 is a perspective view showing how two-dimensional displacement sensor LS representing a measuring instrument is installed at a prescribed position on the front plate 101 side of image forming unit stand 100, while, FIG. 9 is a top view showing how to measure distance L1 from the two-dimensional displacement sensor LS up to main body skeletal structure shafts 32*a* and 32*b*. Further, how to measure distance L2 from writing unit 3 to main body skeletal structure shafts 32*a* and 32*b* is also shown.

In this case, the prescribed position means a reference position where a unit that needs positioning for measuring a distance up to main body skeletal structure shafts 32*a* and 32*b* is set. For example, in the case of developing unit 4, it is also possible to establish a reference position with an angle that is formed by intersection of a bottom surface of stay 103 where developing unit 4Y is installed and of one side on the main body skeletal structure shaft 32*a* side of the elongated hole that is provided on the front plate 101 of the image forming unit stand 100, to insert the developing unit.

For the purpose of measuring a distance from two-dimensional displacement sensor LS to main body skeletal structure shafts 32*a* and 32*b*, it is necessary to provide, on main body skeletal structure shafts 32*a* and 32*b*, exposed sections that serve as measuring positions for measuring instruments. In the present embodiment, there are provided exposed section 321*a* of the section where an end portion of main body skeletal structure shaft 32*a* is protruded from the front panel 11, and exposed section 322*a* located between the front panel and the rear panel. In the same way, there are provided exposed section 321*b* of the section where an end portion of main body skeletal structure shaft 32*b* is protruded from the front panel 11 and exposed section 322*b* located between the front panel and the rear panel (see FIG. 9). The exposed sections 322*a* and 322*b* are the portions which can be observed through hole Hf (see FIG. 7) provided on the front panel 31*f* of casing 31, for example.

In the same way, even in the case of replacing writing unit 3, it is possible to install the two-dimensional displacement sensor LS at a prescribed position to measure distance L2 up to the main body skeletal structure shafts 32*a* and 32*b*, and thereby, to carry out verification of positional accuracy and to take measure (see FIG. 9).

In addition, it is also possible to check positional relations between drum shafts 105Y, 105M, 105C and 105K and main body skeletal structure shafts 32*a* and 32*b*, and relations between intermediate transfer unit 60 and main body skeletal structure shafts 32*a* and 32*b*, through an omission of details.

In the image forming apparatus of the present embodiment, when measuring positional relations between the main body skeletal shaft fixed on each of a pair of panels and a unit that needs positioning, by using a measuring instrument after completion of assembling of the image forming apparatus, it is possible to carry out positional measurement for the unit and verification of accuracy, even after completion of assembling of the image forming apparatus, because the exposed section serving as a measuring position for the measuring instrument is provided on the main body skeletal structure shaft, as stated above.

What is claimed is:

1. An image forming apparatus for forming an image on a sheet, comprising:

a pair of panels which constitute a main body skeletal structure of the image forming apparatus and face each other;

a plurality of main body skeletal structure shafts which connects between the pair of panels and are fixed to each of the pair of panels; and a unit which is installed between the pair of panels and needs positioning based on the plurality of main body skeletal structure shafts, wherein an exposed section is provided on each of the plurality of main body skeletal structure shafts and serves as a measuring reference position for a measuring instrument when a positional relationship between each of the plurality of main body skeletal structure shafts and the unit is measured by use of the measuring instrument after completing assembling of the image forming apparatus.

2. The image forming apparatus described in claim 1, wherein the exposed section is an end portion of each of the plurality of main body skeletal structure shafts which passes through at least one panel of the pair of panels.

3. The image forming apparatus described in claim 2, wherein the end portion protrudes from the at least one panel of the pair of panels.

4. The image forming apparatus described in claim 1, wherein the plurality of main body skeletal structure shafts are arranged in parallel.

5. The image forming apparatus described in claim 1, wherein the plurality of main body skeletal structure shafts includes a first standard shaft and a second standard shaft which are provided for a purpose of positioning in rotational directions of the pair of panels, wherein a standard hole with which the first standard shaft is engaged and a standard hole with which the second standard shaft is engaged are provided at one of the pair of the panels and a standard hole with which the first standard shaft is engaged and an elongated hole to absorb hole-boring errors, with which the second standard shaft is engaged, are provided at an other of the pair of panels.

6. An image forming apparatus comprising:

a pair of panels which constitute a main body skeletal structure of the image forming apparatus and face each other;

a main body skeletal structure shaft which connects between the pair of panels and is fixed to each of the pair of panels; and a unit which is installed between the pair of panels and needs positioning based on the main body skeletal structure shaft, wherein the unit is installed between the pair of panels so that the main body skeletal structure shaft passes through at least a part of the unit, and wherein an exposed section is provided on the main body skeletal structure shaft and serves as a measuring reference position for a measuring instrument when a positional relationship between the main body skeletal structure shaft and the unit is measured by use of the measuring instrument after completing assembling of the image forming apparatus.

7. A positioning method of a unit which is installed in an image forming apparatus for forming an image on a sheet, the image forming apparatus comprising: a pair of panels which constitute a main body skeletal structure of the image forming apparatus and face each other; a plurality of main body skeletal structure shafts which connects between the pair of panels and are fixed to each of the pair of panels; and the unit which is installed between the pair of panels, the positioning method comprising:

measuring an exposed section provided on each of the plurality of main body skeletal structure shafts as a measuring reference position for a measuring instrument, and measuring a positional relationship between each of the plurality of main body skeletal structure shafts and the unit after completing assembling of the image forming apparatus; and positioning the unit based on the positional relationship measured by use of the measuring instrument.

8. The positioning method described in claim 7, wherein the exposed section is an end portion of each of the main body skeletal structure shafts which passes through at least one panel of the pair of panels.

9. The positioning method described in claim 8, wherein the end portion protrudes from the at least one panel of the pair of panels.

10. The positioning method described in claim 7, wherein the plurality of main body skeletal structure shafts are arranged in parallel.

11. The positioning method described in claim 7, wherein the plurality of main body skeletal structure shafts includes a first standard shaft and a second standard shaft which are provided for a purpose of positioning in rotational directions of the pair of panels, wherein a standard hole with which the first standard shaft is engaged and a standard hole with which the second standard shaft is engaged are provided at one of the pair of the panels and a standard hole with which the first standard shaft is engaged and an elongated hole to absorb hole-boring errors, with which the second standard shaft is engaged are provided at an other of the pair of panels.

12. A positioning method of a unit which is installed in an image forming apparatus for forming an image on a sheet, the image forming apparatus comprising: a pair of panels which constitute a main body skeletal structure of the image forming apparatus and face each other; a main body skeletal structure shaft which connects between the pair of panels and is fixed to each of the pair of panels; and the unit which is installed between the pair of panels so that the main body skeletal structure shaft passes through at least a part of the unit, the positioning method comprising:

measuring an exposed section provided on the main body skeletal structure shaft as a measuring reference position for a measuring instrument, and measuring a positional relationship between the main body skeletal structure shaft and the unit after completing assembling of the image forming apparatus; and positioning the unit based on the positional relationship measured by use of the measuring instrument.

* * * * *